United States Patent [19]

Straw

[11] 4,387,040

[45] Jun. 7, 1983

[54] LIQUID TOILET SOAP

[75] Inventor: Alan Straw, Macclesfield, England

[73] Assignee: Colgate-Palmolive Company, New York, N.Y.

[21] Appl. No.: 307,270

[22] Filed: Sep. 30, 1981

[51] Int. Cl.[3] ..... C11D 9/30

[52] U.S. Cl. ..... 252/368; 252/18; 252/108; 252/117; 252/118; 252/132; 252/173; 252/367; 252/DIG. 5; 252/DIG. 14; 260/413

[58] Field of Search ..... 252/18, 108, 117, 132, 252/367, 368, 118, 173, DIG. 5, DIG. 14; 260/413 S

[56] References Cited

U.S. PATENT DOCUMENTS 2,300,416 11/1942 Grondal et al. ..... 260/417
2,912,385 11/1959 Golub et al. ..... 252/132
3,554,916 1/1971 Kerfoot et al. ..... 252/152
4,085,126 4/1978 McConnell et al. ..... 260/404

FOREIGN PATENT DOCUMENTS 52-66504 6/1977 Japan ..... 252/108

*Primary Examiner*—John E. Kittle
*Assistant Examiner*—Robert A. Wax
*Attorney, Agent, or Firm*—Herbert S. Sylvester; Murray M. Grill; John A. Stemwedel

[57] ABSTRACT

A stable liquid toilet soap which includes a potassium soap which is a mixture of potassium soap of lauric acid and myristic acid and a viscosity controlling composition which is a mixture of coconut diethanolamide and sodium sulfate. The soap compositions have moderate viscosity, good odor, foam performance and feel.

6 Claims, No Drawings

LIQUID TOILET SOAP

This invention relates to liquid toilet soap compositions. More particularly, this invention concerns stable liquid soap compositions having moderate viscosity and characterized by good odor, good foam performance and good feel.

Liquid soap and detergent products are well known. Their uses have been for consumer, commercial and industrial applications in hand or laundry cleaners, in stock soap solutions and in the preparation of solid products. Representative of such products are those shown in U.S. Pat. No. 2,089,305 which discloses a liquid soap composition containing unsaturated fatty acid soaps, in U.S. Pat. No. 2,153,143 which relates to an antiseptic liquid soap composition that contains wood oils in addition to soap, in U.S. Pat. No. 2,551,634 which shows a liquid laundry soap composition consisting of the salt of an oleic acid, isopropyl alcohol, and a glycolether modifying agent, and in U.S. Pat. No. 2,792,347 which sets forth both bar and liquid soaps having a high proportion of unsaturated fatty acid salt soaps. Additionally, U.S. Pat. No. 3,862,049 shows a dry detergent powder composition into which a substantial amount of unsaturated fatty acids are included in the liquid soap phase, U.S. Pat. No. 3,972,823 provides a pumpable solution for commercial laundry use having a mixture of fatty acid soap and free fatty acid, and U.S. Pat. No. 4,065,398 discloses a liquid soap for stock solutions for laundry usage and the like comprising a mixture of saturated and unsaturated fatty acid soaps. The products of the prior art have not been suitable for use as liquid toilet soaps since it has been found that in the presence of air the ethylenic groups of the unsaturated fatty acids are oxidized and rancidity results.

Traditional liquid soaps based upon unsaturated fatty acids (coco, oleic, soya, etc.) have had poor lathering characteristics. The soaps usually consist of a blend of coco soap and oleates (or soaps derived from soya or other vegetable oils rich in oleic acid). Coco soaps are rapid-foaming providing large coarse bubbles. Soya or oleic acid derived soaps give mediocre performance, but have as their main virtue good solubility. Coco soaps are well known for their drawback of being relatively harsh on the skin.

Synthetic detergent products often impart poor feel during and after use and require additives to improve these aspects of performance. Often synthetics degrease the skin excessively and may leave a tacky feel. True soaps provide more lubricity and slipperiness than do synthetic detergents.

It has now been found that stable concentrated liquid aqueous soap compositions can be obtained if the soap comprises a mixture of potassium salts of lauric acid and myristic acid and coconut diethanolamide.

Accordingly, the invention provides a stable liquid aqueous soap composition comprising of 7.5 to 20% of a mixture of the potassium soaps consisting essentially of lauric acid and myristic acid soaps and from 6 to 9% of a viscosity controlling component consisting essentially of a mixture of coconut diethanolamide and sodium sulfate.

The invention further provides an aqueous skin/hand cleaner based on saturated soaps with good storage stability and performance superior to soaps based upon unsaturated fatty acids by the interaction of coconut diethanolamide and sodium sulfate to give correct viscosity and stability characteristics.

It is believed that the potassium laurate and potassium myristate-containing composition eliminates the irritating low chain length fatty acids present in coconut fatty acids and optimizes creaminess and foam performance by the high level of myristate.

Table I shows the development of a perfumed liquid soap composition with a viscosity of around 1000–1500 cps at 25° C. and having satisfactory low temperature performance.

TABLE I

| | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| Potassium hydroxide (36.5% solution) | 7.4 | | | | | | | | | 3.45 | 3.45 | 3.4 | 7.0 | 5.4 | 6.4 | 9.5 | 12.7 | 12.7 |
| Sodium hydroxide (−6.6% solution) | | 3.9 | 3.9 | 3.9 | 3.9 | 3.9 | 3.9 | 3.9 | 3.9 | 1.95 | 1.95 | | | | | | | |
| Triethanol amine | | | | | | | | | | | | 3.4 | | | | | | |
| Coco fatty acids | 2.5 | 2.5 | 2.5 | 2.5 | 2.5 | | 2.5 | | | | | | | 2.0 | 5.0 | | | |
| Lauric acid (90%) | 8.5 | 8.5 | 8.5 | 8.5 | 8.5 | 8.5 | 8.5 | 8.5 | 8.5 | 8.5 | 5.5 | 5.5 | 5.5 | | | 7.5 | 10.0 | 10.0 |
| Myristic acid (90%) | | | | | | 2.5 | | 2.5 | 2.5 | 2.5 | 5.5 | 5.5 | 5.5 | | | 7.5 | 10.0 | 10.0 |
| Tallow fatty acids | | | | | | | | | | | | | | | 6.0 | | | |
| Stearic acid, triple pressed | | | | | | | | | | | | | | 8.0 | | | | |
| Coconut diethanolamide | 6.0 | 6.0 | 6.0 | 6.0 | 6.0 | 6.0 | 6.0 | 6.0 | 6.0 | 6.0 | 6.0 | 6.0 | 6.0 | 5.5 | 5.5 | 8.3 | 3.0 | 11.0 |
| Sodium sulfate | 5.0 | 3.5 | 2.0 | 3.5 | 4.0 | 3.0 | 3.0 | 3.0 | 6.0 | 3.0 | 3.0 | 2.5 | 3.0 | 1.0 | 2.0 | 1.5 | 3.0 | |
| Glycerine | | | | | | | | | | | | | 5.0 | 4.5 | 4.5 | 6.8 | 9.0 | |
| Cellulose methyl ether | | | | | | 0.5 | 1.0 | | 1.0 | | | | | | | | | |
| Perfume | 1.0 | 1.0 | 1.0 | 1.0 | 1.0 | | 1.0 | 1.0 | 1.0 | 1.0 | | | 1.0 | 1.0 | 1.0 | 1.0 | 1.0 | 1.0 |
| Viscosity** | 800 | 500 | 150 | 600 | 400 | 2450 | 1500 | 300 | 2000 | 1400 | 4000 | Very thin | 1450 | Solid at 25° C. | 3300 | 300 | 900 | Solid before all CDEA |

TABLE I-continued

| | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| | | | | | | | | | | | | | | | | | | added |
| Stability*** | Sls | G4 OK | G4 OK | G4 OK | G4 OK | G4 S/S | G4 S | G4 S/S | G4 S/S | G4 OK | G4 OK | GrS | G4 OK | | OK | G4 OK | G4 OK | |

Notes to Table I

*Each formulation included, in addition to the tabulated ingredients, 1% pearlizing material (ethylene glycoldistearate), formalin, color, minor additives such as protein (at about 0.4%) and the tetra-sodium salt of EDTA at 0.25% with deionized water to bring the formula to 100%.

**RVT., Spindle 3, Speed 10 rpm.

***G4 = Gel at 40° C., S = separation, Sls = slight separation GrS = gross separation, OK - stable, i.e. no separation or graininess All formulae except 1, 12, and 15 gelled at 4° C. Example 1 was too thin, Example 12 separated overnight and Example 15 had extremely poor hand washing performance. Example 13 provided a product which gelled at 4° C. but showed promising low temperature performance. The remaining examples show parameters for adjusting the amount of caustic material, thickening agent, and fatty acid components. Examples 10, 13 and 17 show formulae that are acceptable in meeting the parameters of viscosity, odor, foam performance and feel.

TABLE II

| | 19 | 20 | 21 | 22 | 23 | 24 | 25 | 26 | 27 | 28 | 29 | 30 | 31 | 32 | 33 | 34 | 35 |
|---|---|---|---|---|---|---|---|---|---|---|---|---|---|---|---|---|---|
| Water | 65.25 | 65.25 | 68.25 | 67.25 | 66.25 | 65.25 | 65.25 | 65.25 | 65.25 | 65.25 | 70.25 | 70.85 | 75.65 | 78.25 | 68.25 | 71.65 | 74.75 |
| Potassium Hydroxide | 7.0 | 7.0 | 7.0 | 7.0 | 7.0 | 3.7 | 4.6 | 5.6 | 6.1 | 6.5 | 7.0 | 6.3 | 5.6 | 4.9 | 6.3 | 5.6 | 4.9 |
| Triethanolamine | — | — | | | | 3.3 | 2.4 | 1.4 | 0.9 | 0.5 | — | — | — | — | — | | |
| Myristic Acid | 5.5 | 5.5 | 5.5 | 5.5 | 5.5 | 5.5 | 5.5 | 5.5 | 5.5 | 5.5 | 5.5 | 5.0 | 4.4 | 3.9 | 5.0 | 4.4 | 3.9 |
| Lauric Acid | 5.5 | 5.5 | 5.5 | 5.5 | 5.5 | 5.5 | 5.5 | 5.5 | 5.5 | 5.5 | 5.5 | 5.0 | 4.4 | 3.9 | 5.0 | 4.4 | 3.9 |
| Coconut Diethanolamide | 6.0 | 6.0 | 6.0 | 6.0 | 6.0 | 6.0 | 6.0 | 6.0 | 6.0 | 6.0 | 6.0 | 5.4 | 4.8 | 4.2 | 5.5 | 4.8 | 4.2 |
| Sodium Sulfate | 3.0 | 3.0 | 3.0 | 3.0 | 3.0 | 3.0 | 3.0 | 3.0 | 3.0 | 3.0 | 3.0 | 2.7 | 2.4 | 2.1 | 2.7 | 2.4 | 2.1 |
| Glycerine | 5.0 | | | | | 5.0 | | | | | | | | | 4.5 | 4.0 | 3.5 |
| Urea | — | 5.0 | 2.0 | 3.0 | 4.0 | | | | | | | | | | | | |
| Gelled at 4° C.? | Yes | Yes | Yes | Yes | Yes | ? | ? | Yes | Yes | Yes | Yes | Yes | Yes | Yes | O.K. | O.K. | O.K. |
| Stable? | Yes | ? | ? | ? | ? | Split at R.T. | ? | ? | ? | ? | | | | | Yes | Yes | Yes |

*Each formula includes EDTA $Na_4$ (0.25%), Protein (0.4%), formalin (0.1%), Perfume (1.0%) and Ethyleneglycol distearate (1.0%)

The addition of triethanolamine is shown in Examples 24–28. At low levels if failed to eliminate low temperature gelling. At higher levels, it gave unstable products which split into two layers overnight.

In preparing the samples of Examples 16, 17 and 18, it was noted that when the sodium sulfate was at 1.5% with levels of cocodiethanolamide lower than 7% in Example 16, the formula was definitely too thin. In Example 17 where there was 3.0% sodium sulfate present, solutions made using 1% or 2% coconutdiethanolamidemade products that were too thin while 3% coconutdiethanolamide made a satisfactory product. And in Example 18 where there was no sodium sulfate, but about double the soap content, the product was thin until about 5% cocodiethanolamide was added and became stiff and unworkable by the time 8% cocodiethanolamide was present. It thus seems that viscosity is more dependent upon sodium sulfate than cocodiethanolamide even though low levels of cocodiethanolamide are known to adversely affect low temperature stability.

Although preferred embodiments of this invention have now been described, many variations and modifications will now be apparent to those skilled in the art. It is preferred, therefore, that this invention not be limited by the specific disclosure herein, but only by the appended claims.

I claim:

1. A stable aqueous liquid toilet soap solution containing from 7.5 to 20% of a potassium soap consisting essentially of a mixture of potassium soaps of lauric acid and myristic acid and from 6 to 9% of a viscosity controlling component consisting essentially of a mixture of coconut diethanolamide and sodium sulfate, such that the viscosity of the solution is between 1000 and 1500 cps.

2. The liquid soap solution of claim 1 wherein the potassium soap of lauric acid is present from 3.9 to 10%, and the potassium salt of myristic acid is present from 2.5 to 10%.

3. The liquid soap solution of claim 2 wherein the ratio of lauric acid to myristic acid is from 3.4:1 to 1:1.

4. The liquid soap solution of claim 1 wherein the pH is between 8.5 and 9.2.

5. The liquid soap solution of claim 1 wherein coconut diethanolamide is present from 3 to 6% and sodium sulfate is present from 2.1 to 3%.

6. The liquid soap solution of claim 5 wherein the ratio of coconutdiethanolamide to sodium sulfate is from 2:1 to 1:1.

* * * * *